US007532167B2

(12) United States Patent
Liang et al.

(10) Patent No.: US 7,532,167 B2
(45) Date of Patent: May 12, 2009

(54) COMMUNICATION DEVICE WITH ANTENNA RETAINING DEVICE

(75) Inventors: Jen-Yu Liang, Tu-Cheng (TW); Kuang-Hsin Hsu, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 86 days.

(21) Appl. No.: 11/322,096

(22) Filed: Dec. 29, 2005

(65) Prior Publication Data

US 2006/0284771 A1 Dec. 21, 2006

(30) Foreign Application Priority Data

Jun. 18, 2005 (CN) ..... 2005 1 0035438

(51) Int. Cl.
*H01Q 1/24* (2006.01)

(52) U.S. Cl. ..... 343/702; 343/888

(58) Field of Classification Search ..... 343/711–715, 343/882, 888, 702

See application file for complete search history.

(56) References Cited

U.S. PATENT DOCUMENTS 4,538,155 A * 8/1985 Stewart ..... 343/715

FOREIGN PATENT DOCUMENTS

CN 2596564 Y 12/2003
JP 2000-332520 A 11/2000

* cited by examiner

*Primary Examiner*—Michael C Wimer

(57) ABSTRACT

A communication device includes a housing (20) and an antenna (10). The housing comprises a retaining portion (22). The retaining portion defines a hole (24) surrounded by an inner wall (21). The inner wall includes a plurality of rib portions (28) parallel to a center axis (220) of the hole. A length of each of the rib portions is shorter than an overall length of the inner wall. Ends of the rib portions cooperatively form a step (27), and a pair of stop walls (29) is formed at opposite ends of the step respectively. The rib portions define a plurality of slots (26) therebetween. The antenna is rotatably attached to the retaining portion. The antenna includes a protrusion (166), and a width of each of the slot is slightly smaller than that of the protrusion. The stop wall and the protrusion cooperatively prevent the antenna from rotating excessively.

14 Claims, 4 Drawing Sheets

COMMUNICATION DEVICE WITH ANTENNA RETAINING DEVICE

BACKGROUND

1. Field of the Invention

The present invention pertains to communication devices, and particularly to a communication device with an antenna retaining device that can be used for securely mounting an antenna to a housing of the communication device.

2. General Background

Communication devices, such as access points (AP), mobile phones, and so on, are becoming ever more popular. In typical communication devices, an antenna is a necessary unit. The main function of the antenna is to transmit and receive signals. The antenna fixed to the communication device often needs rotating so as to obtain an optimum effect in the transmission and reception of signals. In addition, the exposed antenna is vulnerable to damage from external impact, and production costs of antennas and related components needs to be greatly reduced to realize a gain in market competitiveness. Hence, the mechanism designed for fixing an antenna to a communication product needs to possess the features of durability and low cost. In particular, the mechanism should ensure that conductive wires connected to the antenna can withstand rotation of the antenna without rupturing.

Referring to FIG. 1, this shows a simplified, exploded, perspective view of part of a conventional communication product. The communication product comprises an antenna 40, a housing 60, and a metal cylindrical tube 50. The antenna 40 is installed on the housing 60 via the tube 50.

However, the tube 50 and the antenna 40 are easily pulled out of the housing 60 during use. In addition, the antenna 40 is liable to be rotated excessively during use, resulting in the rupturing or entanglement of the conductive wires of the antenna 40. Furthermore, the antenna 40 is prone to sustain abrasion, and thereby may lose its ability to transmit and receive signals.

Therefore, a heretofore unaddressed need exists in the industry to overcome the aforementioned deficiencies and inadequacies.

SUMMARY

In a preferred embodiment, a communication device comprises a housing and an antenna. The housing comprises a retaining portion. The retaining portion defines a hole surrounded by an inner wall. The inner wall comprises a plurality of rib portions parallel to a center axis of the hole. A length of each of the rib portions is shorter than an overall length of the inner wall. Ends of the rib portions cooperatively form a step, and a pair of stop walls is formed at opposite ends of the step respectively. The rib portions define a plurality of slots therebetween. The antenna is rotatably attached to the retaining portion. The antenna comprises a protrusion, and a width of each of the slot is slightly smaller than that of the protrusion. The stop wall and the protrusion cooperatively prevent the antenna from rotating excessively.

Compared with a conventional communication device, the communication device of the preferred embodiment has the following advantages. Firstly, the antenna cannot be rotated excessively during use. Thereby, a conductive wire of the antenna is protected from being ruptured. Secondly, the antenna cannot be easily pulled out of the retaining portion, thus preventing damage. Thirdly, the retaining portion is prevented from shrinking during manufacturing using an injection molding process.

Other advantages and novel features will become more apparent from the following detailed description when taken in conjunction with the accompanying drawings, in which:

DETAILED DESCRIPTION OF THE EMBODIMENTS

Figure 1:
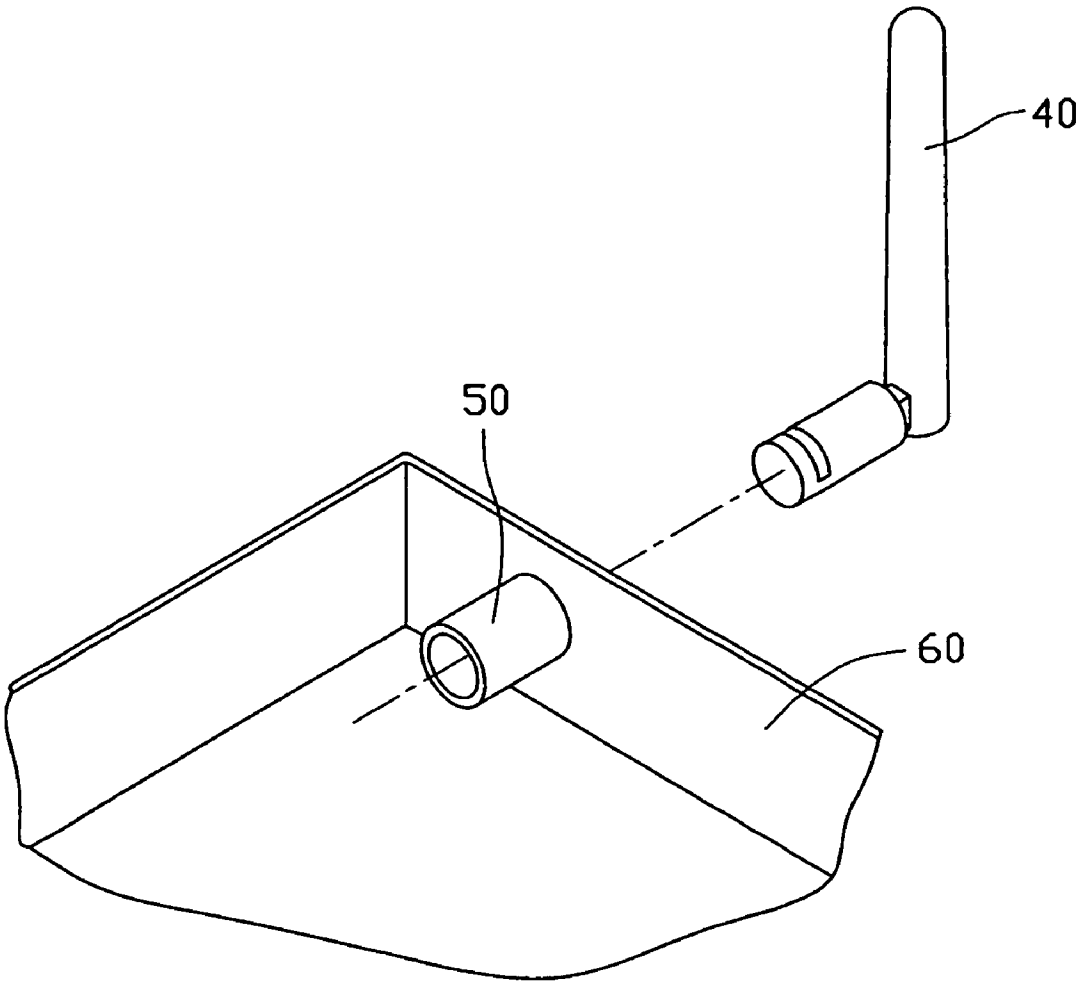
FIG. 1 (RELATED ART)
FIG. 1 is a simplified, exploded, isometric view of part of a conventional communication device.
Figure 2:
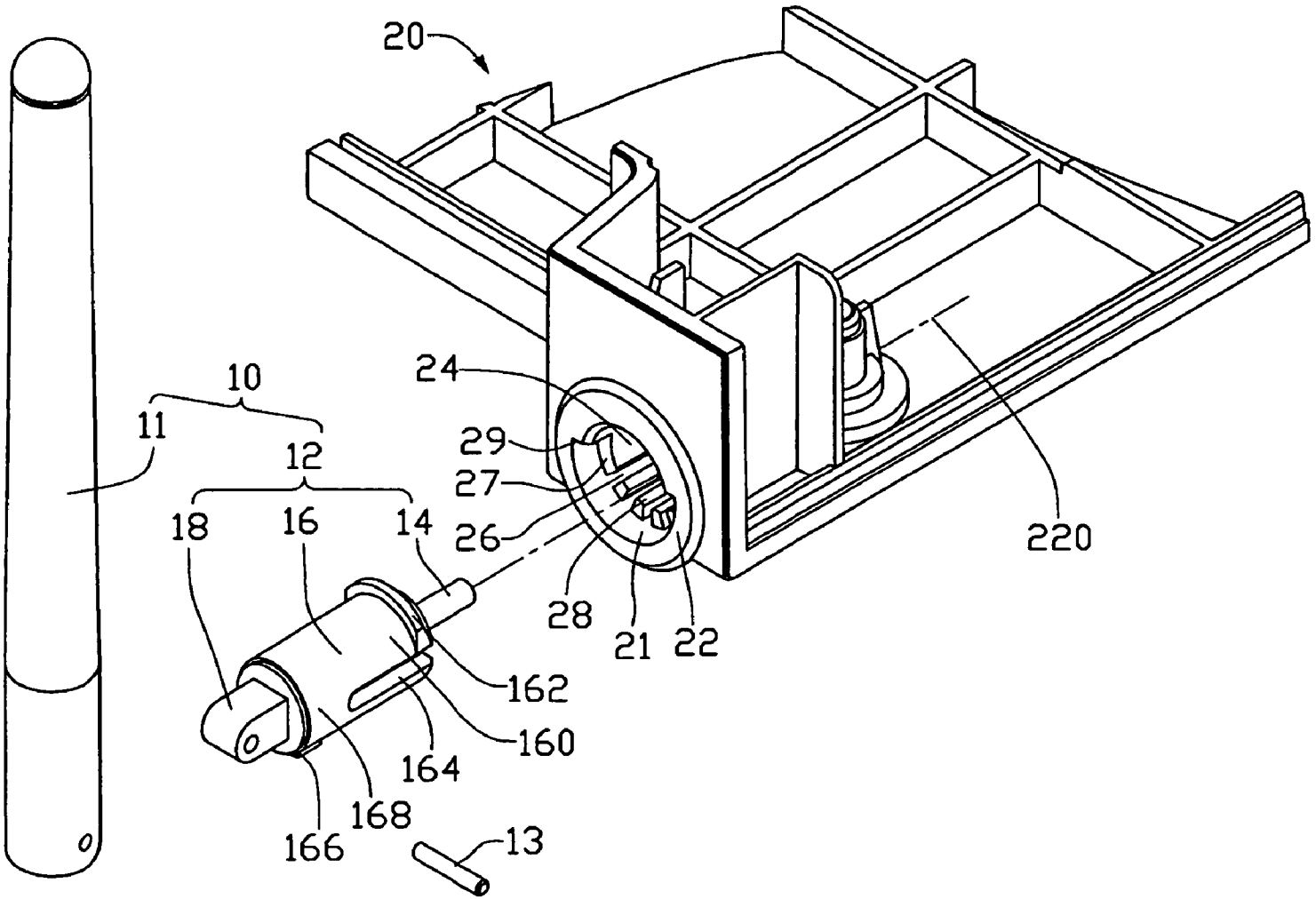
FIG. 2 is a simplified, exploded, isometric view of part of a communication device in accordance with a preferred embodiment of the present invention.

Referring to FIG. 1, a communication device in accordance with the preferred embodiment of the present invention comprises an antenna 10 and a housing 20.

The housing 20 is used for receiving various electronic members, such as printed circuit boards, and comprises a space. A retaining portion 22 is formed in a sidewall of the housing 20. A hole 24 is defined in the retaining portion 22, and communicates with the space. The hole 24 defines a center axis 220, and is surrounded by an inner wall 21 which extends perpendicular to an outer surface of the sidewall. A depth of the hole 24 is equal to a length of the inner wall 21. The inner wall 21 comprises a plurality of recessed rib portions 28. The rib portions 28 are parallel to the center axis 220, and define a plurality of slots 26 therebetween. Each of the slats 26 communicates with the hole 24. A length of each of the rib portions 28 is shorter than an overall length of the inner wall 21. Ends of the rib portions 28 cooperatively form a generally semicircular step 27. A pair of stop walls 29 is defined in the inner wall 21 at opposite ends of the step 27.

The antenna 10 can be rotatably received in the retaining portion 22 of the housing 20. The antenna 10 comprises a connecting member 12, a transceiving member 11, and a pin 13 for connecting the connecting member 12 with the transceiving member 11. The connecting member 12 can be rotatably received in the hole 24 of the housing 20. The transceiving member 11 is used for receiving or transmitting signals. The connecting member 12 comprises a conductive wire 14, a cylinder 16, and a head 18 rotatably connected to the transceiving member 11. A diameter of the cylinder 16 is substantially the same as or slightly greater than a diameter of a main portion of the hole 24 of the retaining portion 22. This is to enable the cylinder 16 to undergo rotation within the hole 24, and to enable the cylinder 16 to remain steady in a new desired position once the rotation has been completed. That is the antenna 10 is held in any of various desired positions by friction between portions of the cylinder 16 located in the hole 24 and the inner wall 21 of the retaining portion 22 which surrounds the hole 24. The cylinder 16 comprises a first end portion 160 and an opposite second end portion 168. A protrusion 166 extends from a periphery of the second end portion 168. The protrusion 166 and the stop walls 29 cooperatively prevent the antenna 10 from rotating excessively. A width of the protrusion 166 is slightly greater than that of any of the slots 26, so that the protrusion 166 cannot enter any of the slots 26. The first end portion 160 comprises an arch-shaped skirt 162 located at a periphery of a free end thereof. A pair of opposite grooves 164 is defined in the cylinder 16, the grooves 164 spanning from a central portion of the cylinder 16 to the first end portion 160 adjacent opposite ends of the skirt 162. The grooves 164 provide the cylinder 16 with resiliency, so that the cylinder 16 can be deformably received through the hole 24.

Figure 3:
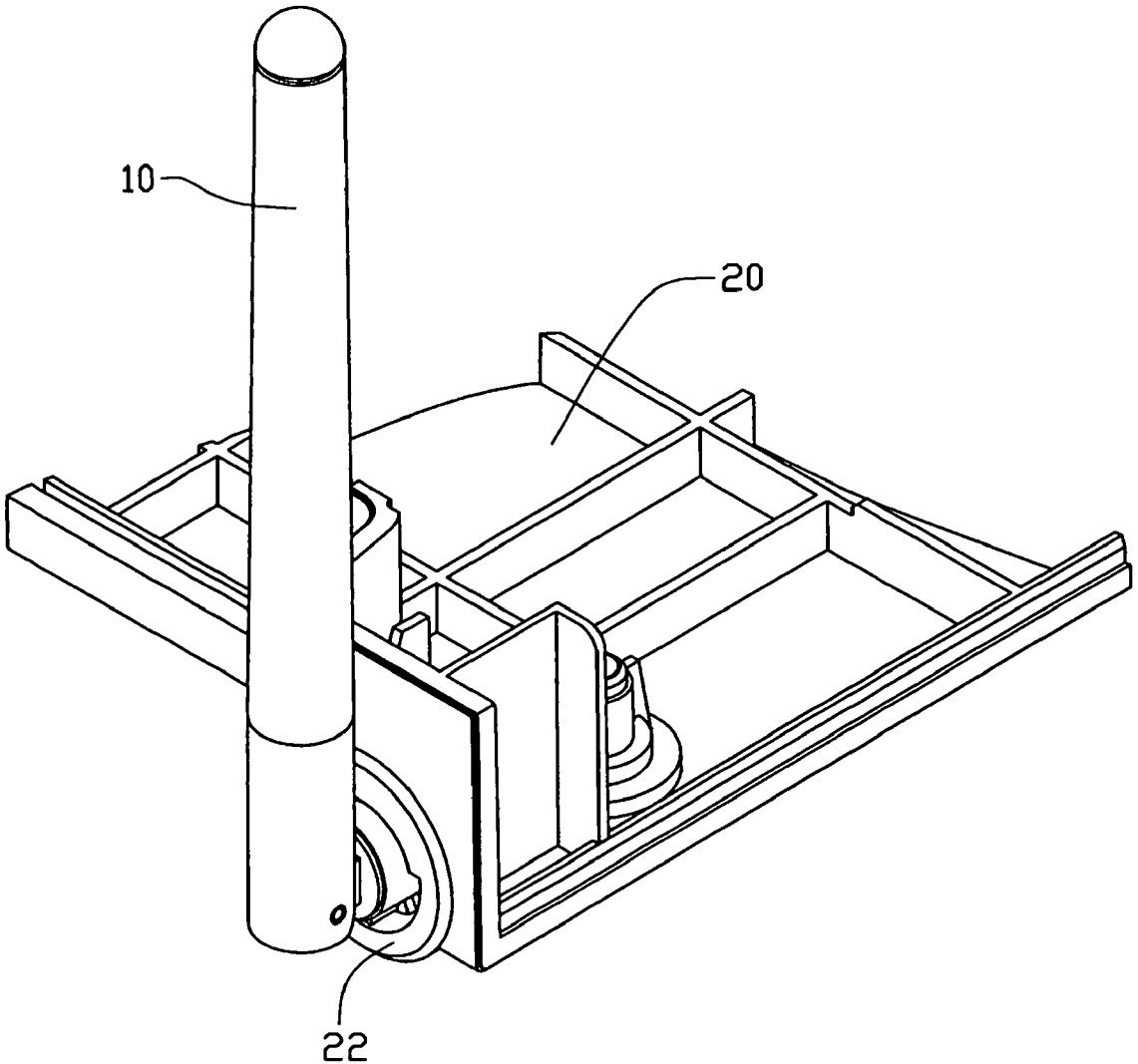
FIG. 3 is an assembled view of FIG. 2.
Figure 4:
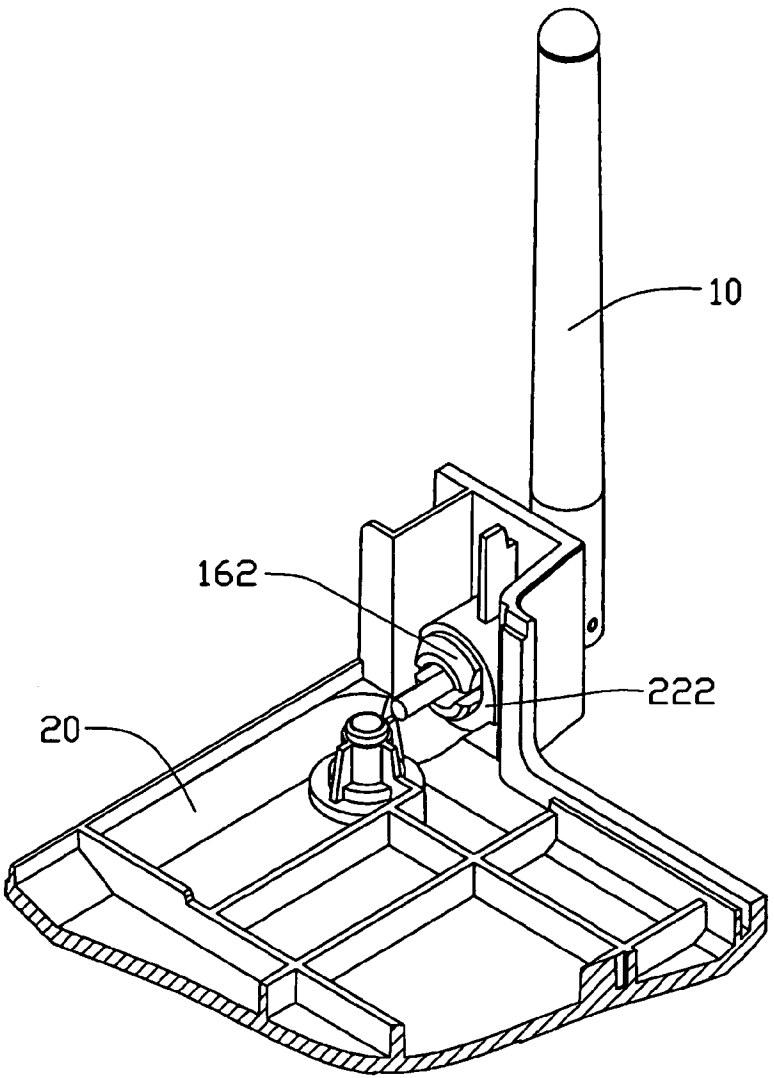
FIG. 4 is similar to FIG. 3, but viewed from another aspect.

Referring also to FIGS. 3 and 4, in assembly, the connecting member 12 of the antenna 10 is inserted into the hole 24 of the housing 20. The cylinder 16 of the connecting member 12 is squeezed and deformably received through the hole 24 until the skirt 162 of the cylinder 16 has passed through the hole 24. The cylinder 16 resiliently rebounds, so that the skirt 162 snaps into position opposite an end wall 222 of the housing 20. Thereby, the antenna 10 is rotatably mounted in the hole 24 of the housing 20. In this assembled state, the protrusion 166 of the antenna 10 abuts the step 27 of the housing 20, and the skirt 162 of the antenna 10 abuts the end wall 222 of the housing 20. In disassembly, the skirt 162 of the cylinder 16 is pushed radially inwardly until it is deformably received in the hole 24. Then the cylinder 16 of the antenna 10 can be slid out from the hole 24 of the housing 20.

Because the skirt 162 of the antenna 10 abuts against the end wall 222 of the housing 20, the antenna 10 cannot be accidentally pulled out of the hole 24 of the housing 20 during use. In addition, the antenna 10 can thereby be protected from damage.

The stop walls 29 of the retaining portion 22 prevent the antenna 10 from being rotated excessively during use. Therefore, rupturing of the conductive wire 14 is prevented. Thus, the antenna 10 can be rotated safely while obtaining an optimum effect in the transmission and reception of signals.

The slots 26 of the inner wall 21 minimize or eliminate shrinkage of the retaining portion 22 during manufacturing involving injection molding. This helps ensure that the retaining portion 22 is correctly sized.

Because the cylinder 16 has good resilience, the connecting member 12 can be easily passed through the hole 24 of the retaining portion 22. Thus the antenna 10 can be assembled or disassembled easily.

While a preferred embodiment has been described above, it should be understood that it has been presented by way of example only and not by way of limitation. Thus the breadth and scope of the present invention should not be limited by the above-described exemplary embodiment, but should be defined only in accordance with the following claims and their equivalents.

I claim:

1. A communication device comprising:

a housing comprising a retaining portion formed in a sidewall thereof, the retaining portion defining a hole surrounded by an inner wall of the sidewall which extends perpendicular to an outer surface of the sidewall, a depth of the hole equal to a length of the inner wall, the inner wall comprising a pair of stop walls located in the hole; and an antenna rotatably attached to the retaining portion, the antenna comprising a protrusion received in the hole;

wherein the stop walls and the protrusion cooperatively prevent the antenna from rotating excessively.

2. The communication device as claimed in claim 1, wherein the inner wall comprises a plurality of rib portions protruding into the hole from the inner wall, which are parallel to a center axis of the hole.

3. The communication device as claimed in claim 2, wherein a length of each of the rib portions is shorter than an overall length of the inner wall.

4. The communication device as claimed in claim 2, wherein ends of the rib portions cooperatively form a step, and the stop walls are formed at opposite ends of the step respectively.

5. The communication device as claimed in claim 4, wherein the step has a generally semicircular shape.

6. The communication device as claimed in claim 2, wherein the rib portions define a plurality of slots therebetween, and the slots communicating with the hole are configured for minimizing shrinkage of the retaining portion during manufacturing involving injection molding.

7. The communication device as claimed in claim 6, wherein a width of each of the slots is less than a corresponding width of the protrusion.

8. The communication device as claimed in claim 1, wherein the antenna further comprises a transceiving member and a connecting member rotatably connected to the transceiving member, the connecting member frictionally received in the hole of the retaining portion to bold the antenna in any of various desired rotational position in the hole by means of friction between the inner wall and the connecting portion.

9. The communication device as claimed in claim 8, wherein the connecting member comprises a first end portion, a cylinder, and an opposite second end portion adjacent to the transceiving member, and the protrusion projects from the second end portion.

10. The communication device as claimed in claim 9, wherein the first end portion comprises a skirt at a periphery of a free end thereof.

11. The communication device as claimed in claim 10, wherein a pair of grooves is defined in the cylinder, the grooves spanning from a central portion of the cylinder to the first end portion adjacent opposite ends of the skirt.

12. A communication device comprising:

a housing comprising a space, a retaining portion integrally formed with said housing at a side of said housing so as to define a bole therein to communicate said space in said housing with an outside of said communication device, a plurality of spaced rib portions protruding into said hole from an inner wall of said hole; and an antenna removably installable in said hole of said retaining portion and held in any of various desired rotational positions in said hole by means of friction between said inner wall of said hole arid portions of said antenna located in said hole.

13. The communication device as claimed in claim 12, wherein a stop wall is formed in said hole so as to be engagable with said antenna for preventing said antenna from undesired rotation.

14. The communication device as claimed in claim 12, wherein the rib portions define a plurality of slots therebetween, and the slots communicate with the hole and minimize shrinkage of the retaining portion during manufacturing involving injection molding.

* * * * *